US006194828B1

(12) United States Patent
Kohne et al.

(10) Patent No.: US 6,194,828 B1
(45) Date of Patent: Feb. 27, 2001

(54) ELECTRODELESS GAS DISCHARGE LAMP HAVING FLAT INDUCTION COIL AND DUAL GAS ENVELOPES

(75) Inventors: Robert L. Kohne, Noblesville; Jack D. Bodem, Jr., Kokomo, both of IN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/168,472

(22) Filed: Oct. 8, 1998

(51) Int. Cl.[7] ..... H01J 1/62; H01J 63/04; H01J 1/50; H01J 23/10; H01J 29/76

(52) U.S. Cl. ..... 313/493; 313/161; 313/634; 313/160; 315/39; 315/248

(58) Field of Search ..... 313/156–57, 491–493, 313/234, 607, 627–28, 631–32, 634–35, 637–643, 161, 160, 17, 25–26, 31, 38–40, 43, 44–45; 315/248, 39, 111.21, 111.51, 34, 283, 344, 246; 445/26, 28; 362/84, 267, 328, 329, 335, 310, 317

(56) References Cited

U.S. PATENT DOCUMENTS

| | | |
|---|---|---|
| 3,636,396 | 1/1972 | Gruzdev . |
| 5,349,271 | 9/1994 | van Os . |
| 5,500,574 | 3/1996 | Popov . |
| 5,619,103 | 4/1997 | Tobin . |
| 5,734,221 | 3/1998 | van Os . |

*Primary Examiner*—Nimeshkumar D. Patel
*Assistant Examiner*—Mack Haynes
(74) *Attorney, Agent, or Firm*—Reising, Ethington, Barnes, Kisselle, Learman & McCulloch, P.C.

(57) ABSTRACT

An electrodeless gas discharge light assembly includes a lamp base (12) having a pair of light-transmitting lenses (14, 16) supported in axially opposed relation to one another. An electrodeless gas discharge light source (28) is mounted between the lenses (14, 16) and comprises a generally flat spiral induction coil (30) sandwiched between a pair of generally flat, planar envelopes (32, 34) in which an ionizable gas (46) is contained. Energizing the coil (30) inductively induces discharge illumination of the gas (46) causing light to be emitted in axially opposite directions through the lenses (14, 16) without obstruction by the coil (30).

14 Claims, 3 Drawing Sheets

ELECTRODELESS GAS DISCHARGE LAMP HAVING FLAT INDUCTION COIL AND DUAL GAS ENVELOPES

BACKGROUND OF THE INVENTION

1. Technical Field

This invention relates generally to electrodeless gas discharge lamps and more particularly to the configuration and arrangement of the induction coil and the envelope in which the discharge gas is sealed.

2. Related Prior Art

Various arrangements for the induction coil and envelope of gas discharge lamps are known and generally involve locating the induction coil external of the envelope in closely adjacent relationship therewith. The envelope often has a generally cylindrical shape and is surrounded by a helically coiled induction wire. When energized, the coil excites the gas within the envelope to discharge illumination. The light which is emitted is blocked somewhat in the radial direction by the induction coil but not in the axial direction of the free end of the envelope. In many applications that employ this type of coil and envelope arrangement, the light is intended to be directed axially rather than radially and thus the blockage of light in the radial direction by the coil does not inhibit the performance of the light.

In another known arrangement, a flat spiral induction coil is supported adjacent a flat envelope and the light which evolves is emitted forwardly of the envelope, but is blocked in the opposite axial direction by the presence of the coil on the backside of the envelope. In these known applications, such blockage of the light by the coil does not present a problem since the light is intended to be directed in the forward direction only.

In other lighting applications, such as emergency flasher beacon lights of the type used, for example, on road construction pylons, barriers, signs and the like, the light is directed in opposite axial directions from a central incandescent light source through a pair of axially oppositely disposed lenses of the device. The incandescent lamp is often powered by a battery housed within a lamp base which mounts the incandescent lamp and lenses. Both the incandescent lamp and battery have a limited operating life, and as such the present emergency flasher beacons require periodic maintenance which adds cost and inconvenience to their usage.

It would be desirable to replace the incandescent lamp source with an electrodeless gas discharge lamp source since it would eliminate the presence of an electrode (i.e., a filament) which is the principal cause for the failure of incandescent lamps. An electrodeless gas discharge lamp source would further draw far less power than a comparable incandescent lamp and its usage would prolong the operating life of the battery, minimizing or altogether eliminating the requirement for frequent maintenance associated with the known incandescent beacon flashers.

There does not currently exist, however, an electrodeless gas discharge light source suitable for such a double-sided lighting application. In the case of the discharge lamps described above, the induction coil in each case would interfere with the emittance of light through at least one of the lenses and as such would impair the performance of the light.

The present invention is directed at providing such an electrodeless gas discharge lighting configuration suitable for double-sided lighting applications.

SUMMARY OF THE INVENTION AND ADVANTAGES

An electrodeless gas discharge lamp assembly constructed according to the present invention includes a lamp base, a pair of light-transmitting lenses mounted on the base in axially opposed relation to one another, and is characterized by an electrodeless gas discharge illumination source including a generally flat spiral induction coil disposed between the lenses having axially opposite sides, and a pair of generally flat gas discharge envelopes disposed between the lenses on the opposite sides of the coil each having sealed therein an ionizable gas inductively excitable to discharge illumination by operation of the coil.

Such an axially sandwiched arrangement of the coil and the two envelopes has the advantage of exciting the gas in both envelopes with a single coil, directing the light in axially opposite directions without obstruction from the coil. While not limited in its application, the invention is particularly well suited for emergency flasher or beacon-type lights wherein the light from the central source is transmitted in a)dally opposite directions through the opposed lenses of the device. The electrodeless gas discharge light source has the further advantage over conventional incandescent lamp sources of minimizing or all together eliminating the need to periodically replace the light source and prolonging the life of the battery of such assemblies by operating at a relatively lower rate of energy consumption.

BRIEF DESCRIPTION OF THE DRAWINGS

These and other features and advantages of the present invention will become more readily appreciated when considered in connection with the following detailed description and appended drawings, wherein.

DETAILED DESCRIPTION

Figure 1:
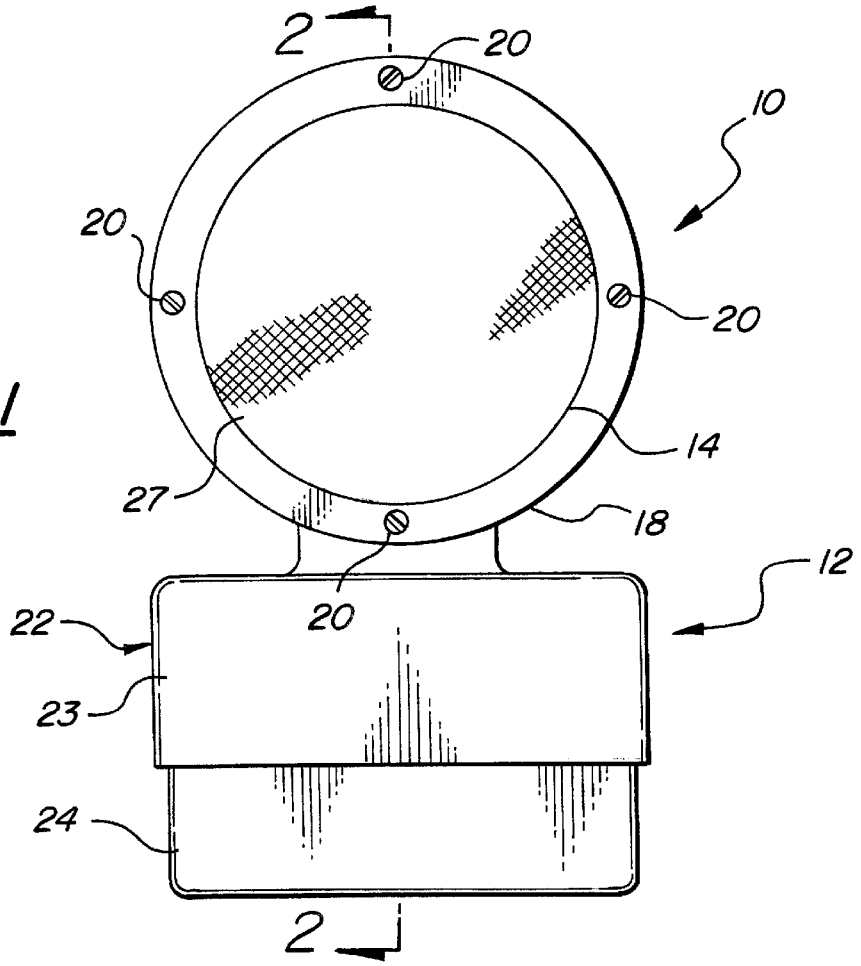
FIG. 1 is a front elevation view of a lamp assembly constructed according to the invention.

An electrodeless gas discharge lamp assembly constructed according to a presently preferred embodiment of the invention is indicated generally at 10 in the drawings and comprises a lamp base 12 mounting a pair of light-transmitting lenses 14, 16 supported in axially opposite relation to one another defining a space 17 therebetween. The lenses 16 are generally flat and planar, although they may be bowed somewhat convexly away from one another as illustrated in FIG. 2. The lenses 16 lie in parallel planes and are aligned along a central axis A of the assembly 10. The base 12 may have a ring 18 that preferably is circular on which the lenses 16, which are likewise preferably circular when view along the axis A as in FIG. 1, are mounted by means such as the screws 20 of FIG. 1 or by other suitable means, including clips, fasteners, adhesives, and the like.

Figure 2:
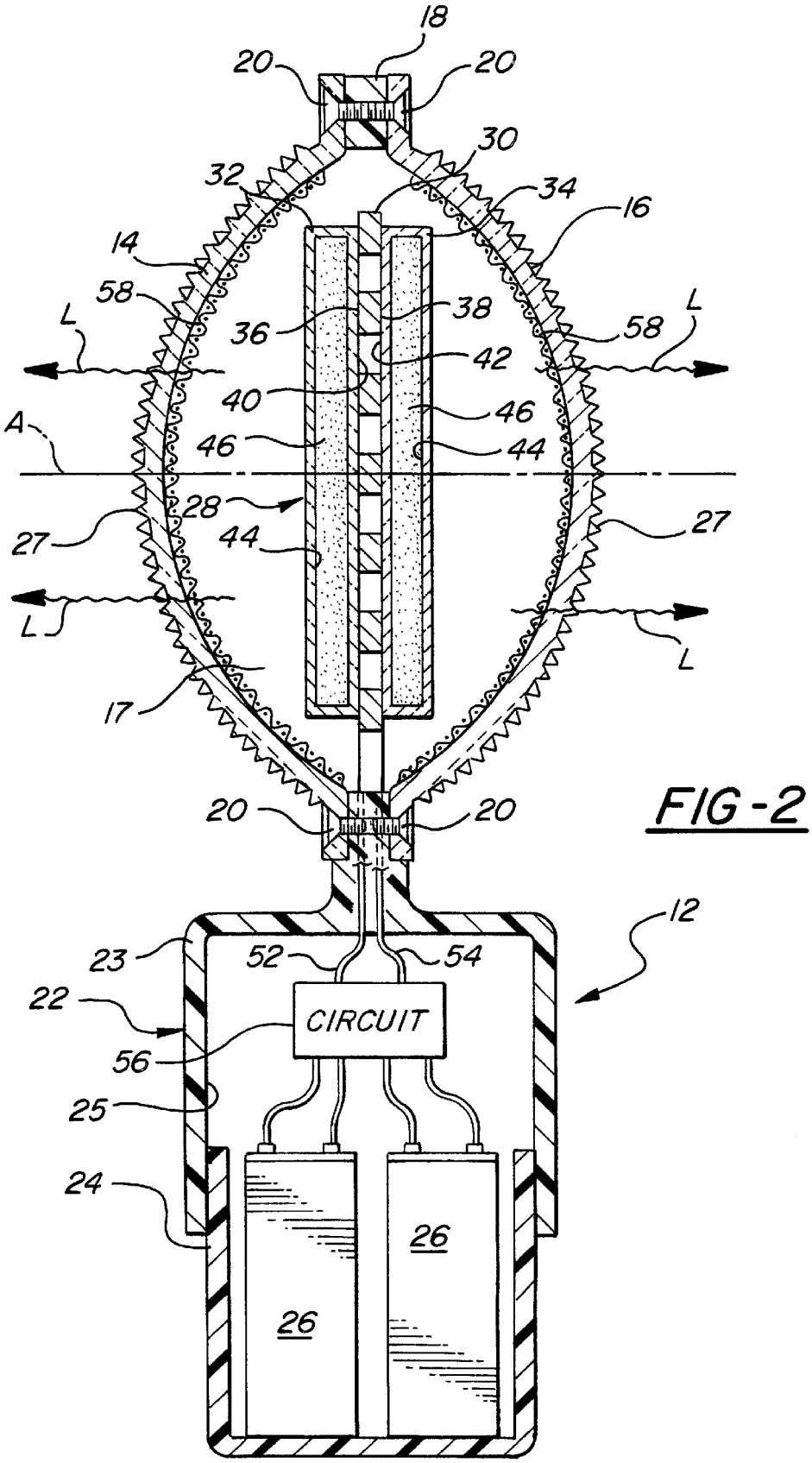
FIG. 2 is an enlarged cross-sectional view taken along lines 2—2 of FIG. 1.

The light assembly 10 depicted in FIGS. 1 and 2 is preferably an emergency flasher or beacon light of the general type commonly used to mark barriers, pylons, signs, equipment and the like to gain the attention of those in the vicinity of the need to exercise caution.

The base 12 has a housing 22 that may include separable upper and lower housing portions 23, 24 defining a cavity 25 within the housing. An on-board power source in the preferred form of one or more batteries 26 is supported with the cavity 25 of the housing 22 so as to be protected from the elements and to provide electrical power to the illumination source to be described below. The separable housing portions 23, 24 provide access to the cavity 25 and the contents therein.

The lenses 14, 16 may be manufactured to include a light-diffusing pattern or features 27 provided across the surface thereof for diffusing the light transmitted through the lenses 14, 16 in predetermined manner to achieve the desired lighting characteristics.

Figure 3:
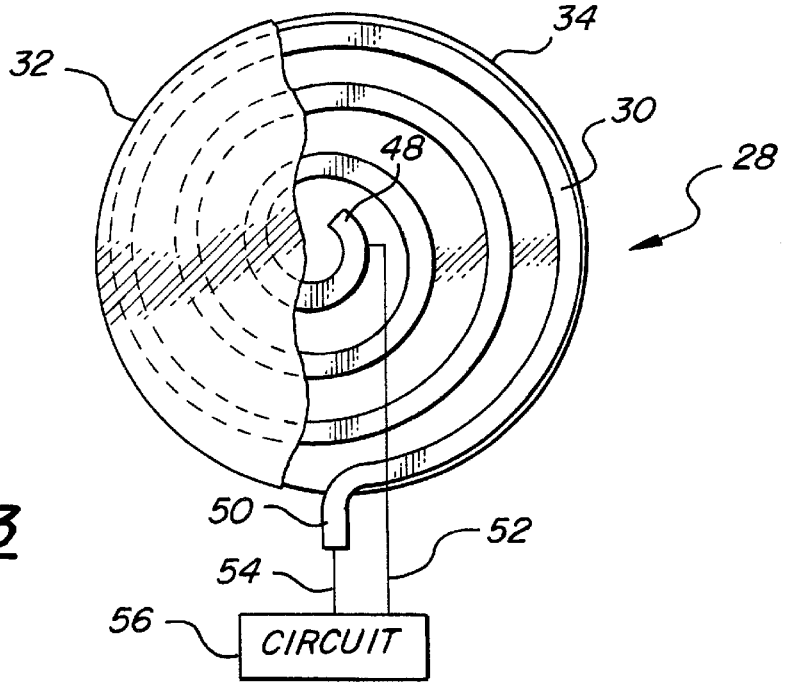
FIG. 3 is an enlarged fragmentary front elevation view of the gas discharge light source of FIGS. 1 and 2.

According to the invention, an electrodeless gas discharge lamp source 28 is provided in the space 17 between the lenses 14, 16 for supplying light. The source 28 comprises a generally flat spiral induction coil 30 axially sandwiched between a pair of generally flat, planar light-transmitting envelopes 32, 34. As shown best in FIGS. 2 and 3, the coil 30 and envelopes 32, 34 are preferably united as a single, integrated subassembly wherein the coil 30 is sandwiched in fixed relation between the two envelopes 32, 34 and secured by means of a suitable adhesive or the like.

The coil 30 has axially opposite sides 36, 38 with respect to the axis A. An inner surface 40 of the envelope 32 engages one side 36 of the coil, whereas an inner surface 42 of the other envelope 34 engages the opposite side 38 of the coil 30. The envelopes 32, 34 are preferably separate and distinct from one another each defining an enclosed space 44 in which an ionizable gas 46 is sealed and excitable to discharge illuminated when ionized by operation of the induction coil 30 according to known principals. Any of a number of ionizable gases suitable for electrodeless gas discharge lighting applications may be employed, including, for example, neon, xion, mercury, mixtures of these and/or others.

The envelopes 32, 34 may be fabricated of quartz or the like suitable for transmitting light while retaining the gas 46 therein. The envelopes 32, 34 preferably correspond in shape to that of the lenses 14, 16, and thus are preferably circular when viewed in the direction of the axis A. The envelopes 32, 34 are further preferably concentric with the lenses 14, 16 and thus lie along the axis A.

The coil 30 is coupled at its ends 48, 50 by lead wires 52, 54, respectively, to an induction circuit 56 supported within the base 12. The circuit 56 is, in turn, electrically coupled to the energy supply or batteries 26. The circuit 56 is operative to convert the power supplied by the batteries 26 to induce the induction coil 30 to emit high frequency energy signals which act on the gas 46 to ionize and excite the gas to discharge illumination. It is preferred that the circuit 56 and coil 30 operation in the RF range such that the coil 30 emits RF signals to drive the gas 46. The principals of discharge illumination through high frequency induction signals are well know to those in the art and thus will not be elaborated upon here.

As illustrated by the directional light rays L of FIG. 2, the light given off by the gas 46 in the envelopes 32, 34 will be directed outwardly through the lenses 14, 16 in axially opposite directions along the axis A without obstruction from the coil 30. In other words, by locating the coil 30 axially between the envelopes 32, 34, there is a direct path for the light emitted from the envelopes 32, 34 to transmit through the lenses 14, 16 without encountering the coil 30.

As mentioned earlier, the assembly 10 of the drawings is preferably an emergency-type flasher. It is thus preferred that the circuit 56 include suitable flasher circuitry which would act to energize the coil 30 in timed pulses in order to produce corresponding timed illumination of the gas 40 to achieve the flashing effect. In other words, the circuit 56 would operate to energize and then deenergize the coil in repeated timed cycles to achieve an on/off flashing of the light assembly 10.

The assembly 10 may further include a high frequency barrier 58 in the preferred form of an RF screen surrounding the coil 30. The screen 58 is operative to permit the passage of light therethrough while blocking the transmission of the high frequency signals generated by the coil so as to contain them within the assembly 10. The screen 58 may be conveniently mounted along the inner surfaces of the lenses 14, 16 and may, for example, be adhered thereto.

Figure 4:
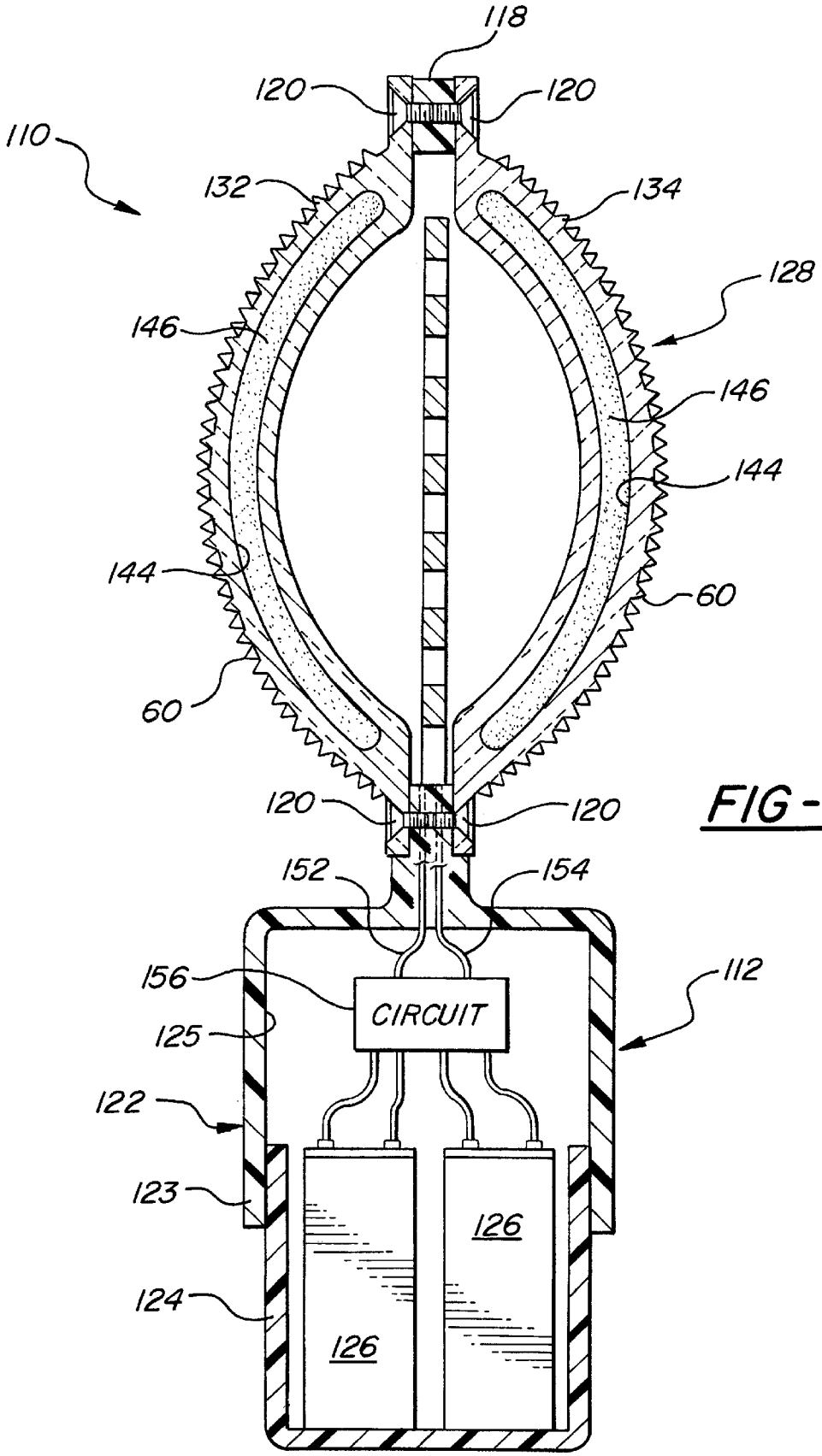
FIG. 4 is a cross-sectional view like FIG. 2 but of an alternative embodiment of the invention.

FIG. 4 shows an alternative embodiment of the invention wherein like features are represented by like reference numerals, but are offset by 100. The base 112 and circuitry 156 are the same as that previously described. The principal difference is the elimination of the lenses 14, 16 and the provision thereof of dual purpose envelopes 32, 34 which serve not only to contain the gas 46 but also serve as the lenses. In the illustration, the envelopes 132, 134 are generally flat and planar, yet are outwardly convex or bowed away from one another to take on a lens shape. The extent of bowing is exaggerated in the drawing figure for purposes of illustration. The coil 130 is supported between the envelopes 132, 134 and serves as before to energize the gas 46 in both envelopes 32, 34. The envelopes 132, 134 may be formed with light-refracting features 60 which act to diffuse the light transmitted through the envelopes 132, 134 to achieve a desired lighting characteristic.

Obviously, many modifications and variation of the present invention are possible in light of the above teachings. It is, therefore, to be understood that within the scope of the appended claims, the invention may be practiced otherwise than as specifically described. The invention is defined by the claims.

What is claimed is:

1. An electrodeless gas discharge lamp assembly comprising:

a lamp base;

a pair of light-transmitting lenses mounted on said base in axially opposed relation to one another; and an electrodeless gas discharge illumination source including:

generally flat spiral induction coil disposed between said lenses, said induction coil having axially opposite sides, and a pair of generally flat gas discharge envelopes each having an ionizable gas scaled therein and each being disposed at one of said axially opposite sides of said coil such that said gas is inductively excitable to discharge illumination by operation of said coil.

2. The assembly of claim 1 wherein said envelopes are generally circular when viewed in the axial direction of said assembly.

3. The assembly of claim 1 wherein said source comprises a unitary structure with said coil being sandwiched between said envelopes.

4. The assembly of claim 1 including a battery power source supported by said lamp base and operatively coupled to said coil.

5. The assembly of claim 4 including an induction flasher circuit coupled to said battery and said coil and operative to energize said coil in timed pulses to produce corresponding flashes of light from pulsed excitation of said gas.

6. The assembly of claim 5 wherein said circuit is supported by said base.

7. An electrodeless gas discharge lamp assembly comprising:

a lamp base; and an electrodeless gas discharge illumination source including:

a generally flat spiral induction coil supported by said base and having axially opposite sides, and a pair of generally flat gas discharge envelopes each having an ionizable gas sealed therein and each being disposed at one of said axially opposite sides of said coil such that said gas is inductively excitable to discharge illumination by operation of said coil.

8. An electrodeless gas discharge lamp source comprising:

a generally flat planar spiral induction coil having axially opposite sides; and characterized by a pair of generally flat planar light-transmitting discharge envelopes disposed on said axially opposite sides of said spiral coil, each of said envelopes having an ionizable gas sealed therein which is inductively excitable to discharge illumination.

9. The source of claim 8 wherein said discharge envelopes are generally circular in shape.

10. The source of claim 8 wherein said envelopes are fixed to said coil to provide a unitary sandwiched structure.

11. The source of claim 8 wherein said envelopes are convexly bowed in axially opposite directions.

12. The source of claim 8 wherein said envelopes each have an axially inner wall and an axially outer wall, said axially outer walls having a light refracting pattern operative to diffuse light transmitted through said outer walls.

13. A method of constructing and operating a double-sided emergency flasher lamp having an electrodeless gas discharge illumination source comprising:

preparing an electrodeless gas discharge illumination source including a generally flat spiraled induction coil having opposite axial sides and a pair of generally flat, planar light-transmitting discharge envelopes disposed in axially opposite relation to one another of the opposite sides of the coil, each envelope having sealed therein an ionizable gas excitable to discharge illumination during energization of the coil; and mounting the illumination source on a lamp base and operating the coil to inductively excite the gas to discharge illumination producing light emitted from the envelopes in axially opposite directions.

14. The method of claim 13 including mounting a pair of light-transmitting lenses on the base axially outwardly of the envelopes, and transmitting the light emitted from the envelopes through the lenses.

* * * * *

UNITED STATES PATENT AND TRADEMARK OFFICE

CERTIFICATE OF CORRECTION

PATENT NO. : 6,194,828 B1
DATED : February 27, 2001
INVENTOR(S) : Robert L. Kohne and Jack D. Bodem, Jr.

It is certified that error appears in the above-identified patent and that said Letters Patent is hereby corrected as shown below:

Column 2,
Line 22, delete "a)dally" and insert therefor -- axially --.

Column 4,
Line 47, before "generally flat" insert therein -- a --.

Signed and Sealed this

Twelfth Day of March, 2002

*Attest:*

*Attesting Officer*

JAMES E. ROGAN
*Director of the United States Patent and Trademark Office*